US007635002B2

(12) United States Patent
Peterson et al.

(10) Patent No.: US 7,635,002 B2
(45) Date of Patent: Dec. 22, 2009

(54) METHOD AND APPARATUS FOR IN-ROOM GLASS WASHING

(75) Inventors: Jeff W. Peterson, Hudson, WI (US); Mary M. Dawson, Lakeville, MN (US); John E. Thomas, River Falls, WI (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 11/283,953

(22) Filed: Nov. 21, 2005

(65) Prior Publication Data

US 2006/0111260 A1 May 25, 2006

Related U.S. Application Data

(60) Provisional application No. 60/630,494, filed on Nov. 23, 2004.

(51) Int. Cl.
*B08B 9/20* (2006.01)
*B08B 3/00* (2006.01)

(52) U.S. Cl. ..... 134/25.2; 134/26; 134/42

(58) Field of Classification Search ..... 134/8, 134/22.1, 22.18, 25.2, 26, 42, 25.1, 29, 166 R; 29/428

See application file for complete search history.

(56) References Cited

U.S. PATENT DOCUMENTS

| | | | | |
|---|---|---|---|---|
| 1,936,259 | A | | 11/1933 | Parmer |
| 2,049,365 | A | | 7/1936 | Follett |
| 2,067,780 | A | | 1/1937 | Clayton |
| 2,565,448 | A | * | 8/1951 | Brownell ..... 294/159 |
| 3,680,567 | A | * | 8/1972 | Hansen ..... 134/57 D |
| 3,688,330 | A | | 9/1972 | Zipper |
| 3,781,939 | A | | 1/1974 | Qualheim |
| 3,878,856 | A | * | 4/1975 | Hall ..... 134/60 |
| 4,805,649 | A | * | 2/1989 | Nezworski ..... 134/57 R |
| 5,870,906 | A | * | 2/1999 | Denisar ..... 68/17 R |
| 6,141,816 | A | | 11/2000 | Burnett |
| 6,453,487 | B1 | * | 9/2002 | Babington ..... 4/619 |
| 2002/0109318 | A1 | * | 8/2002 | Calmeise et al. ..... 280/47.35 |
| 2002/0170323 | A1 | * | 11/2002 | Stahl ..... 68/122 |
| 2004/0195346 | A1 | * | 10/2004 | McIntyre ..... 239/1 |

FOREIGN PATENT DOCUMENTS

| | | | |
|---|---|---|---|
| GB | 2 246 511 A | * | 2/1992 |
| GB | 2293966 | | 4/1996 |
| WO | WO0076387 | | 12/2000 |

* cited by examiner

*Primary Examiner*—Michael Cleveland
*Assistant Examiner*—Nicole Blan
(74) *Attorney, Agent, or Firm*—Andrew D. Sorensen

(57) ABSTRACT

The invention pertains to a method and apparatus of cleaning glassware, for example, in a hotel room or a motel room. More particularly, the invention pertains to a method and apparatus for cleaning, rinsing, and sanitizing glassware.

5 Claims, 1 Drawing Sheet

METHOD AND APPARATUS FOR IN-ROOM GLASS WASHING

CROSS REFERENCE TO RELATED APPLICATION

This application claims priority under 35 U.S.C. §119(e) to U.S. Provisional Application entitled "METHOD AND APPARATUS FOR IN-ROOM GLASS WASHING", Ser. No. 60/630,494, filed on Nov. 23, 2004, which is incorporated herein by reference in its entirety.

FIELD OF THE INVENTION

The invention pertains to a method and apparatus of cleaning glassware, for example, in a hotel room or a motel room. More particularly the invention pertains to a method and apparatus for cleaning, rinsing, and sanitizing glassware.

BACKGROUND

Many hotels and motels put glassware such as drinking glasses, coffee cups, and the like in rooms for guests to use. This glassware is cumbersome to clean and oftentimes, the glassware is either not cleaned, or cleaned improperly. Currently, glassware is properly cleaned by taking it out of the room and to a commercial dishwasher on the hotel or motel premise. This can add a significant cost to a large hotel or motel chain. For example, extra labor is required to move the dirty glassware from the floor of use to the dish machine, and return the clean glassware to the room attendant. In addition, moving in-room glassware to a commercial dishwasher adds the weight of the glassware to the cart as a housekeeper or room attendant pushes the cart from room to room. There also has to be a means of separating clean glassware from dirty glassware on the cart. Finally, glassware can break during the transportation from the room to the commercial dishwasher. Glassware may be cleaned improperly or not cleaned at all. For example, housekeepers may wash the glassware in the bathroom sink and dry it with a bath towel. Also, housekeepers may not realize that the glassware has been used, and subsequently leave dirty glassware in the room for the next guest to use.

Accordingly, there is a need provide housekeepers and room attendants in hotels and motels a method of cleaning in-room glassware in the guest room without the need to take it to a commercial dishwasher on the premise.

SUMMARY

Surprisingly, it has been discovered that glassware can be cleaned in or near the hotel guest room using a portable station having at least two compartments allowing the room attendant or housekeeper to wash, rinse, and sanitize the glassware. This station can be used in conjunction with known detergents, rinse aids, sanitizing agents, pre-treating compositions, mixtures thereof, and the like.

In an embodiment, the invention relates to a method of cleaning glassware in or near a guest room using the following steps: (1) providing a station having at least a wash section, and a sanitizing section, and optionally a rinse section; (2) providing a wash composition in the wash section; (3) providing a sanitizing composition in the sanitizing section; (4) placing the glassware in the wash section; (5) rinsing the glassware, for example, by running the glassware under water or by placing the glassware in the optional rinse section; and (6) placing the glassware in the sanitizing section.

In an embodiment, the invention relates to a method of cleaning glassware in a guest room using the following steps: (1) providing a station having a wash section, a rinse section, and a sanitizing section; (2) providing a wash composition in the wash section; (3) providing a rinse composition in the rinse section; (4) providing a sanitizing composition in the sanitizing section; (5) placing the glassware in the wash section; (6) placing the glassware in the rinse section; and (7) placing the glassware in the sanitizing section.

In an embodiment, the invention relates to a method of cleaning glassware in or near a guest room using the following steps: (1) providing a station having a pretreatment section, a wash section, and a sanitizing section, and optionally a rinse section; (2) providing a pretreatment composition in the pretreatment section; (3) providing a wash composition in the wash section; (4) providing a sanitizing composition in the sanitizing sections; (5) placing the glassware in the pretreatment section; (6) placing the glassware in the wash section; (7) rinsing the glassware under running water or by placing the glassware in the optional rinse section; and (8) placing the glassware in the sanitizing section.

These embodiments will be apparent to those of skill in the art and others in view of the following detailed description of some embodiments. It should be understood, however, that this summary, and the detailed description illustrate only some examples of various embodiments, and they are not intended to be limiting to the invention as claimed.

BRIEF DESCRIPTION OF THE DRAWING

For a more complete understanding of the present invention reference is now made to the following descriptions taken in conjunction with the accompanying drawing in which.

DETAILED DESCRIPTION OF SOME EMBODIMENTS

Definitions

Figure 1:
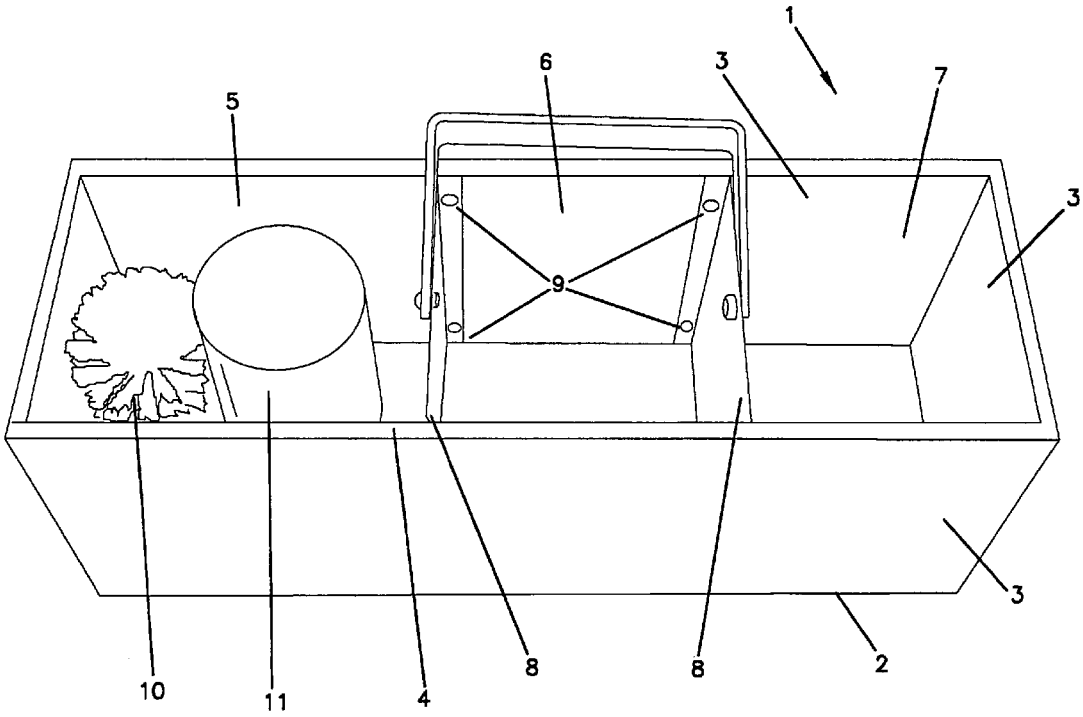
FIG. 1 shows a top view of the portable station.

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure.

Weight percent, percent by weight, % by weight, wt %, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4 and 5).

As used in this specification and the appended claims, the singular forms "a," "an," and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

The use of the terms "antimicrobial" and "biocide" in this application does not mean that any resulting products are approved for use as an antimicrobial agent or biocide.

As discussed above, the invention generally relates to a method and apparatus for cleaning glassware in or near hotel rooms and motel rooms.

In an embodiment, the invention is a portable station. As shown in FIG. 1, the portable station includes a container (1). The container (1) may be made out of any material including but not limited to metal, wood, rubber, nylon, glass, ceramic and plastic. The container (1) is preferably made out of plastic, including but not limited to polyethylene including HDPE (high density polyethylene), LDPE (low density polyethylene), and LLDPE (linear low density polyethylene), EVA (ethylene vinyl acetate), EMA (ethylene methyl acrylate), EAA (ethylene acrylic acid), EMAA (ethylene methyl acrylic acid), PVC (polyvinyl chloride), acrylic and polypropylene. The container is preferably removable so that it may be easily cleaned. Further, the container is preferably dishwasher safe. The container may be formed in a variety of ways including vacuum molded and injection molded. A person of skill in the art will be able to select container material that meets the needs of this invention.

The station can be made portable in a variety of ways. For example, the station can include a handle for carrying from room to room. The station can be designed to fit on a housekeeping cart, i.e., the station can rest in a designated recess in the cart, the station can include hooks, clamps, and the like for attaching the station to the cart, or the station can simply be set on the cart. The station may include legs and wheels for pushing or pulling the station from room to room. The housekeeping cart may be molded to include the station as part of the cart's physical structure. A person of skill in the art will be able to envision these and other ways of making the station portable.

In order to facilitate smooth transportation from room to room, the container may optionally include a cover to prevent liquid from spilling when the container is not in use. The cover may be hinged, such as a clam-shell or flip top cover, or removable.

Because the station of the present invention is intended to be portable, the container is preferably designed to be small enough to be portable. In a preferred embodiment, the container holds a limited amount of composition. In one embodiment, the container holds less than two liters of composition total. In another embodiment, the container holds less than one liter of composition total.

The container (1) includes a bottom (2), and sidewalls (3). The top of the container (4) is preferably open, allowing a room attendant or housekeeper to access the container for cleaning glassware. The container (1) may be a solid container or a rack, frame or base station that smaller sub-containers are suspended or otherwise placed in.

The container (1) is preferably divided up into at least two sections, a wash section (5), and a sanitizing section (7). The container can optionally include additional sections such as a rinse section (6), or a pretreatment section. Any suitable means of dividing up the container and the three sections may be used, however, the dividing means (8) preferably does not allow composition from one section to flow into another section, in order to prevent chemical compositions in the individual sections from mixing with each other. The container may be divided by a dividing material which may be metal, plastic, nylon, wood, and the like. The dividing means may extend from the bottom of the container to the top of the container, or from the bottom of the container to just above the desired water line for composition. The dividing means is preferably a permanent part of the container or secured to the container using fasteners (9). In one embodiment, the container is a rack, frame, or base station and the rack, frame, or base station may be divided by using individual smaller sub-containers for each section.

If the container is a rack, frame, or a base station, and smaller sub-containers are used, the smaller sub-containers are preferably removable. The smaller sub-containers are preferably dishwasher safe. The smaller sub-containers preferably hold a small amount of liquid, for example, less than half a liter, or less than one quarter of a liter. The smaller sub-containers may optionally be color coded to indicate which one is the wash container, the sanitizing container, or the optional rinse container or pretreatment container. The smaller sub-containers may include a lock-out feature that fits with a corresponding portion of the larger container, rack, frame or base station. For example, the smaller sub-containers may have a notch that fits with a corresponding recess on the larger container base station frame or rack or vice versa. Further, the wash container may have a different notch from the sanitizing container such that only a wash container will fit in the wash section and not in the sanitizing container. Such lock-out features will prevent a user from inadvertently placing a smaller sub-container in the wrong section and consequently using the wash, and sanitizing compositions in the wrong order. In an embodiment, the smaller sub-containers may include notches or other physical structure to prevent the smaller sub-containers from rotating once they are placed in the larger container.

The container and/or sub-containers can include indicia for assisting the room attendant or housekeeper with using the station. For example, the container and/or sub-containers can include a marker for the water or composition line that the housekeeper or room attendant should fill water or composition up to. The container and/or sub-containers can also include text indicating which section is the wash section, and which section is the sanitizing section. The text may be in one language or multiple languages. The indicia may be a graphic applied to the container and/or sub-containers or it may be molded directly into the container and/or sub-containers. If a color coding system is used to indicate which sections are which the indicia preferably corresponds to and coordinates with the chosen color coding system. For example, if the wash section is colored blue, the optional rinse section is colored red, and the sanitizing section is colored green, the indicia associated with these sections is preferably blue, red, and green respectively.

The container and/or sub-containers may optionally include cushioning, such as foam, rubber or elastomer, around the rim of the container and/or on the bottom of the container to reduce chipping or breaking of glassware.

The container and/or sub-containers may also optionally including a screen, ribbing, or other physical structure on the bottom of the container and/or sub-containers to allow soils to settle on the bottom and be out of the reach of the glassware when the glassware is placed into the container and/or sub-containers.

The container may optionally include features to assist a user in drying the glassware once it is cleaned. For example, in one embodiment the container may optionally include hooks for hanging drying towels. In another embodiment, the container may include drying racks or screens. The drying racks may be a screen that is hinged to the container such that when the container is not being used, the screen may be folded over the container thus preventing objects from accidentally falling into the container and when the container is being used, the screen may be folded out, for example from one side of the container, or multiple sides of the container, to allow a user to place glassware waiting to be cleaned on, or to place clean glassware on as the glassware dries. In a preferred embodiment, the station would include two of such screens or racks, one for dirty glassware waiting to be cleaned, and one for clean glassware waiting to dry. In another embodiment, the container can include cutouts or voids for resting the lip of the glassware on to dry.

In the wash section of the station, in some embodiments the container and/or sub-containers can include bristles (10) or a brush capable of fitting inside glassware (11), to assist in removing any soil from the glassware. The container or sub-container may include two bristles or brushes such that when the glassware is placed on one bristle or brush, the second bristle or brush is touching the outside of the glass. In this manner, both the inside and outside of the glassware may be cleaned using the bristle or brush for assistance. In some embodiments, the bristle or brush may be motorized. In some embodiments, the wash section may include a sponge or a sponge with cuts or voids to allow the rims of the glassware to penetrate into the sponge.

The wash section may include detergent chemistries known to a person of skill in the art, including alkaline detergents, neutral detergents, and acidic detergents. The wash detergent can also include other ingredients including but not limited to enzymes, surfactants, builders, and the like. Examples of suitable detergent compositions include PAN-DANDY, PANTASTIC, or SCOUT detergents, commercially available from Ecolab Inc. (St. Paul, Minn.).

The optional rinse section can include water, or water plus a rinse additive. For example, the rinse section can include rinse surfactants that promote sheeting, or prevent water spotting on glasses.

The optional pretreatment section can include bristles or brushes or a sponge. The pretreatment section can also include chemistries designed to remove especially problematic soils such as lipstick soils and coffee and tea stains. Examples of pretreatment chemistries include solvents and surfactants capable of removing waxy soils, such as lipsticks as well as bleaching compositions known to a person skilled in the art including oxygen bleaches and chlorinated bleaches.

The sanitizing section of the container can include an antimicrobial agent for disinfecting the glasses. The antimicrobial agent can be selected from those generally know in the art including but not limited to phenolics, halogen compounds, quaternary ammonia compounds, metal derivatives, amines, alkanolamines, nitro derivatives, analides, organosulfur and sulfur-nitrogen compounds, hydrogen peroxide, and peracid compounds. Examples of suitable sanitizing compositions include OASIS 145 and OASIS 146, commercially available from Ecolab Inc. (St. Paul, Minn.).

The various chemistries may be added to the container and/or sub-containers in a variety of ways. For example, the container or sub-container can include a re-fillable pump or dispenser where liquid or solid chemistry is placed in the pump or dispenser and dispensed as needed. Alternatively, the chemistry can be added to the container as a unit dose tablet, powder, packet (e.g. powder or solid in a water soluble film such as polyvinyl alcohol), or woven or non-woven fabric with chemistry adhered onto the fabric. Further, the container or sub-container may be disposable and come pre-loaded with a unit dose of the desired chemistry.

In another embodiment, the present invention relates to a method of cleaning glassware in a hotel room or motel room using a station. The method includes providing the room attendant or housekeeper with a portable station having at least two sections, a washing section (5), and a sanitizing section (7) and optionally a rinse section and a pretreatment section. According to the method, the room attendant or housekeeper can clean the glassware provided to guests in the room, for example, while the room attendant or housekeeper is cleaning the rest of the room, by taking the glassware and inverting it first into the washing section. In one embodiment, the washing section includes bristles (10), brushes, or a sponge, for helping to remove soil on the glassware. After dipping the glassware in the washing section, the room attendant or housekeeper then removes the glassware from the washing section and either places the glassware in the rinsing section or runs the glassware under water. Once the glassware is rinsed, the housekeeper or room attendant places the glassware into the sanitizing section. After sanitizing the glassware, the glassware is dried before returning the glassware to the room.

In some embodiments, the water and compositions in the container are discarded regularly and new water and compositions is added. In some embodiments, the water and compositions are discarded and replaced after every room, after every other room, after every fifth room, or after every floor.

In a preferred embodiment, each progressive steps takes place in a left-to-right motion where the optional rinse section is to the right of the wash section, and the sanitizing section is to the right of the wash section or the optional rinse section.

The foregoing summary and detailed description provide a sound basis for understanding the invention, and some specific example embodiments of the invention. Since the invention can comprise a variety of embodiments, the above information is not intended to be limiting. The invention resides in the claims.

What is claimed is:

1. A method for assembling a portable station, the portable station for cleaning glassware in a hotel or motel, the method comprising:

attaching a base station to a housekeeping cart, the base station comprising a plurality of sections;

transporting the housekeeping cart and the attached base station to a guest room of the hotel or motel;

matching a first sub-container to one section of the plurality of sections of the base station in order to avoid placing the first sub-container in any other of the plurality of sections;

fitting the first sub-container into the matched section;

filling the fitted first sub-container with liquid to form a wash composition with a first chemistry, which first chemistry has been pre-loaded into the first sub-container prior to the matching and the fitting thereof, the wash composition for washing a set of the glassware within the first sub-container;

matching a second sub-container to another section of the plurality of sections of the base station;

fitting the second sub-container into the other matched section;

filling the fitted second sub-container with liquid to form a sanitizing composition with a second chemistry, which second chemistry has been pre-loaded into the second sub-container prior to the matching and fitting thereof the sanitizing composition for sanitizing the set of the glassware within the second sub-container;

disposing of one or both of the first and second sub-containers, along with the composition formed therein; and replacing each of the one or both of the disposed of sub-containers with a new sub-container of the same type.

2. The method of claim 1, wherein filling at least one of the first and second sub-containers comprises viewing a marker line for filling up to.

3. The method of claim 1, wherein matching and fitting the first sub-container comprises mating a notch of the first sub-container with a corresponding recess of the one section of the plurality of sections of the base station.

4. The method of claim 1, wherein matching the first sub-container comprises matching a color of the first sub-container to a color of the one section of the plurality of sections of the base station.

5. The method of claim 1, wherein matching the first sub-container comprises reading text formed on the first sub-container.

* * * * *